US012507744B2

(12) United States Patent
Karas et al.

(10) Patent No.: US 12,507,744 B2
(45) Date of Patent: Dec. 30, 2025

(54) PROTECTIVE JACKET FOR MOTORCYCLISTS WITH A DETACHABLE BLAZER

(71) Applicants: Nino Karas, Skopje (MK); Nina Levikj, Skopje (MK)

(72) Inventors: Nino Karas, Skopje (MK); Nina Levikj, Skopje (MK)

( * ) Notice: Subject to any disclaimer, the term of this patent is extended or adjusted under 35 U.S.C. 154(b) by 0 days.

(21) Appl. No.: 18/487,015

(22) Filed: Oct. 13, 2023

(65) Prior Publication Data

US 2025/0120458 A1 Apr. 17, 2025

Related U.S. Application Data

(60) Provisional application No. 63/398,175, filed on Aug. 15, 2022.

(51) Int. Cl.

| | |
|---|---|
| ***A41D 1/02*** | (2006.01) |
| ***A41D 13/015*** | (2006.01) |
| ***A41D 31/24*** | (2019.01) |
| *A41D 3/00* | (2006.01) |
| *A41D 27/04* | (2006.01) |
| *A41D 31/28* | (2019.01) |

(52) U.S. Cl.

CPC ..... *A41D 1/02* (2013.01); *A41D 13/015* (2013.01); *A41D 31/24* (2019.02); *A41D 3/00* (2013.01); *A41D 3/005* (2013.01); *A41D 13/0158* (2013.01); *A41D 27/04* (2013.01); *A41D 31/285* (2019.02); *A41D 2600/102* (2013.01)

(58) Field of Classification Search

CPC ..... A41D 13/0158; A41D 13/015; A41D 2600/102; A41D 1/02; A41D 31/285; A41D 243/00; A41D 243/005; A41D 27/04

USPC ..... 2/461

See application file for complete search history.

(56) References Cited

U.S. PATENT DOCUMENTS

| | | | | | |
|---|---|---|---|---|---|
| 2,301,527 | A * | 11/1942 | English | A41D 27/04 | 2/97 |
| 4,470,155 | A * | 9/1984 | Maeshima | A41D 27/04 | 2/87 |
| 4,722,099 | A * | 2/1988 | Kratz | A41D 27/28 | 2/93 |
| 4,864,656 | A * | 9/1989 | Nesse | A41D 27/04 | 441/106 |
| 5,507,042 | A * | 4/1996 | van der Slessen | A41D 27/28 | 2/108 |
| 5,810,699 | A * | 9/1998 | Nadeau | A63B 21/065 | 2/102 |
| 5,845,336 | A * | 12/1998 | Golde | A41D 27/28 | 2/93 |
| 6,070,274 | A * | 6/2000 | van der Sleesen | A41D 27/28 | 2/DIG. 1 |
| 6,260,196 | B1 * | 7/2001 | van der Sleesen | A41D 27/28 | 2/2.5 |

(Continued)

*Primary Examiner* — Khaled Annis
*Assistant Examiner* — Dakota Marin
(74) *Attorney, Agent, or Firm* — Airman Khosraviani

(57) ABSTRACT

Some embodiments provide a protective motorcycle jacket with a detachable blazer for protecting a motorcyclist. The protective motorcycle jacket with a detachable blazer includes an outer layer comprising textile fabric for providing an appearance of a blazer, and an inner layer comprising abrasion resistant material for providing abrasion resistance to the protective motorcycle jacket with a detachable blazer.

21 Claims, 9 Drawing Sheets

(56) References Cited

U.S. PATENT DOCUMENTS 6,263,509 B1 * 7/2001 Bowen ..... A41D 13/05 2/84
6,263,510 B1 * 7/2001 Bay ..... A41D 27/28 2/93
6,519,781 B1 * 2/2003 Berns ..... A41D 13/0153 2/455
6,766,535 B2 * 7/2004 Duhamell ..... A41D 13/018 2/102
6,854,130 B2 * 2/2005 van der Sleesen .. A41D 27/285 2/69
7,111,328 B2 * 9/2006 Bay ..... A41D 13/0581 2/93
8,528,112 B2 * 9/2013 Blauer ..... F41H 1/02 2/92
10,111,480 B2 * 10/2018 Pezzimenti ..... A41D 31/065
10,219,554 B2 * 3/2019 Farron ..... A41D 13/0015
2002/0174476 A1 * 11/2002 Cochran ..... A62B 17/003 2/97
2007/0136923 A1 * 6/2007 Aldridge ..... A62B 17/003 2/93
2008/0040832 A1 * 2/2008 Bay ..... A41D 27/28 2/93
2008/0060112 A1 * 3/2008 Driehorst ..... A41D 13/015 2/85
2008/0216206 A1 * 9/2008 Mazzarolo ..... A41D 3/00 2/243.1
2009/0077710 A1 * 3/2009 Bay ..... A41D 3/00 2/243.1
2010/0229287 A1 * 9/2010 Mothaffar ..... A42B 3/0473 2/468
2012/0174298 A1 * 7/2012 Bay ..... A41D 31/00 2/463
2013/0318671 A1 * 12/2013 Haider ..... F41H 1/02 2/2.5
2014/0304900 A1 * 10/2014 Sugano ..... A41D 13/0575 2/455
2022/0264973 A1 * 8/2022 Johnson ..... A41D 1/04
2022/0322761 A1 * 10/2022 Karas ..... A41D 27/28

* cited by examiner

PROTECTIVE JACKET FOR MOTORCYCLISTS WITH A DETACHABLE BLAZER

RELATED APPLICATIONS

The present application is a non-provisional application claiming the benefit of U.S. Provisional Application No. 63/398,175, filed Aug. 15, 2022, entitled "Protective Jacket for Motorcyclists with a Detachable Blazer," the entirety of which is incorporated herein by reference.

FIELD OF THE INVENTION

The present invention relates to protective clothing meant for motorcycle riders, and more particularly, relates to a new type of motorcycle gear, that provides a protective motorcycle jacket with a detachable blazer that enables an elegant exterior look of the gear, but has abrasion resistance and impact protection to satisfy all the required safety standards.

BACKGROUND

Motorcycle protective gear is motorcycle equipment that satisfies the required standards for the riders' protection when riding a motorcycle.

Different countries and regions have different safety standards and thus different requirements. However, there are three general categories of requirements that the protective motorcycle clothing needs to meet: abrasion resistance, impact protection, and comfort.

Motorcycle riding clothes for upper body-protection, or widely known as motorcycle jackets, are usually produced out of abrasion-resistant textile fabric or leather. Additionally, impact protectors are incorporated in the shoulder, elbow and the back areas, to prevent injuries in case of an accident.

Even though many manufacturers produce different types and styles of motorcycle jackets that satisfy different safety standards, none of them satisfies nor can be classified as an elegant clothing item.

This presents a problem for many motorcycle riders in the world for whom the motorcycle is the primary mode of transportation. Many of them work in an office environment and have many meetings and events throughout the day that require a business dress code. They can either wear motorcycle gear that doesn't satisfy the business attire and stay safe, or wear suits and blazers to satisfy the desired business look, but ride unprotected risking their health and wellbeing.

Therefore, what is needed is a new type of motorcycle garment for upper body-protection that has a look and form of an elegant blazer to satisfy the business attire, while at the same time has all of the protective properties to satisfy the widely accepted safety standards for motorcycle gear.

SUMMARY

Figure 1:
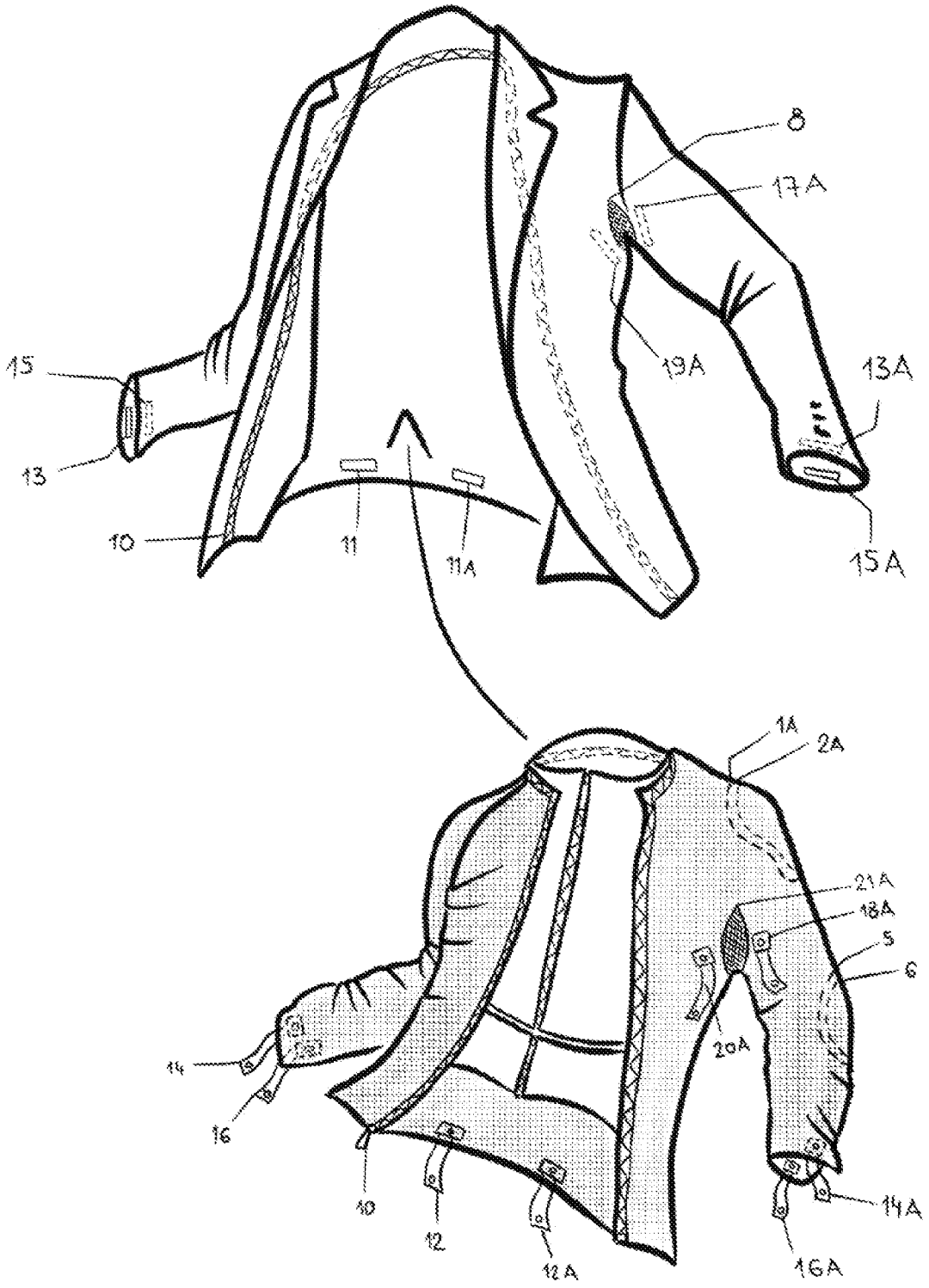
FIG. 1-FIG. 1 illustrates the two different parts of the disclosure, the protective jacket for motorcyclists and the detachable blazer as one example according to various embodiments described herein.

The present invention seeks to provide a solution to this problem by providing a new type of protective motorcycle jacket with a detachable blazer, as an elegant garment with protection and comfort properties that satisfy all the requirements of the widely accepted safety standards for the production of motorcycle gear.

The present invention is composed of, but not limited to two different parts. The outer part consisting of an elegant blazer, and the inner part consisting of a protective motorcycle jacket. These two parts are connectable with special fastening mechanisms and together compose the full garment. The protective jacket is made of an abrasion-resistant material, which provides abrasion resistant properties to the invention. Preferably, the protective jacket incorporates impact protectors in the shoulder, elbow, and back areas, to prevent injuries in case of an accident. A ventilation system consisting of mesh panels is integrated on the armpits of both parts composing the innovation, to enable air circulation within the garment. Special shoulder gussets are incorporated on the blazer, to provide great ergonomics and comfort when riding a motorcycle.

Certain embodiments to the present invention include, but are not limited to:

a) Removable gilet that covers the chest and neck area of the body, and provides wind protection when riding a motorcycle.

b) Impact protector pocket and back impact protector located on the back area of the protective jacket for motorcyclists with a detachable blazer.

In one embodiment, a motorcycle jacket is provided. The motorcycle jacket includes: an outer blazer component made of textile fabric, the outer blazer component including: a left breast panel and a right breast panel, and a first fastening mechanism for securing the left breast panel and the right breast panel together across a torso of a user of the motorcycle jacket; an inner abrasion resistant component made from abrasion resistant material that is secured to the outer blazer component, the inner abrasion resistant component providing a frame for the motorcycle jacket; and a second fastening mechanism internal to the first fastening mechanism that attaches to the frame of the motorcycle jacket and fastens across the torso of the user, wherein the second fastening mechanism prevents displacement of the motorcycle jacket during an abrasion event, wherein the lower torso fastening mechanism is comprised of abrasion resistant material and attached to the inner abrasion resistant layer.

In another embodiments, a protective motorcycle blazer for protecting a motorcyclist is provided. The protective motorcycle blazer includes: an outer part comprising textile fabric for providing an appearance of a blazer and an inner layer comprising abrasion resistant material for providing abrasion resistance to the protective motorcycle blazer.

These and other aspects of the present invention will become apparent to those skilled in motorcycle protective gear after a reading of the following description of the preferred embodiments when considered in conjunction with the drawings. It should be understood that both the foregoing general description and the following detailed description are exemplary only and are not restrictive of the invention as claimed.

DETAILED DESCRIPTION

In the following description, for purposes of explanation, numerous examples and specific details are set forth in order to provide a thorough understanding of the present disclosure. It will be evident, however, to one skilled in the art that various embodiment of the present disclosure as defined by the claims may include some or all of the features in these examples alone or in combination with other features described below, and may further include modifications and equivalents of the features and concepts described herein.

The terminology used herein is for the purpose of describing particular embodiments only and is not intended to be limiting the invention. As used herein, the term "and/or" includes any and all combinations of one or more of the associated listed items. As used herein, the singular forms "a", "an", and "the" are intended to include the plural forms as well as the singular forms, unless the context clearly indicates otherwise.

The present disclosure is to be considered as an exemplification of the invention and is not intended to limit the invention to the specific embodiments illustrated by the figures or description below.

The present disclosure provides a protective jacket for motorcyclists with a detachable blazer, with protection and comfort properties that satisfy all the requirements of the widely accepted safety standards for the production of motorcycle gear. The present invention has the look of a blazer from the outside satisfying the need for elegant motorcycle apparel.

The present invention is composed of, but not limited to two different parts as perhaps best shown in FIG. 1: an outer part consisting of an elegant blazer defining the outer look of the garment and an inner part consisting of a protective motorcycle jacket that provides all the protective properties for the garment.

Preferably, the outer part of the invention is a blazer that is composed of textile fabrics generally used for the production of suits and blazers. This part defines the look of the garment, allowing it to have different colors and styles, depending on the particular design.

In preferred embodiments, under this outer part providing the look of a blazer, an inner part is attached to it with special fastening mechanisms. The inner part is a protective jacket made of abrasion-resistant material and provides abrasion resistance to the disclosure. In preferred embodiments, the inner part is made of protective fabric that is a special blend of materials that incorporate strong synthetic aramid and para-aramid fibers. This makes the garment highly abrasion-resistant, preventing harm to the rider's skin during a slide in an accident.

Figure 2:
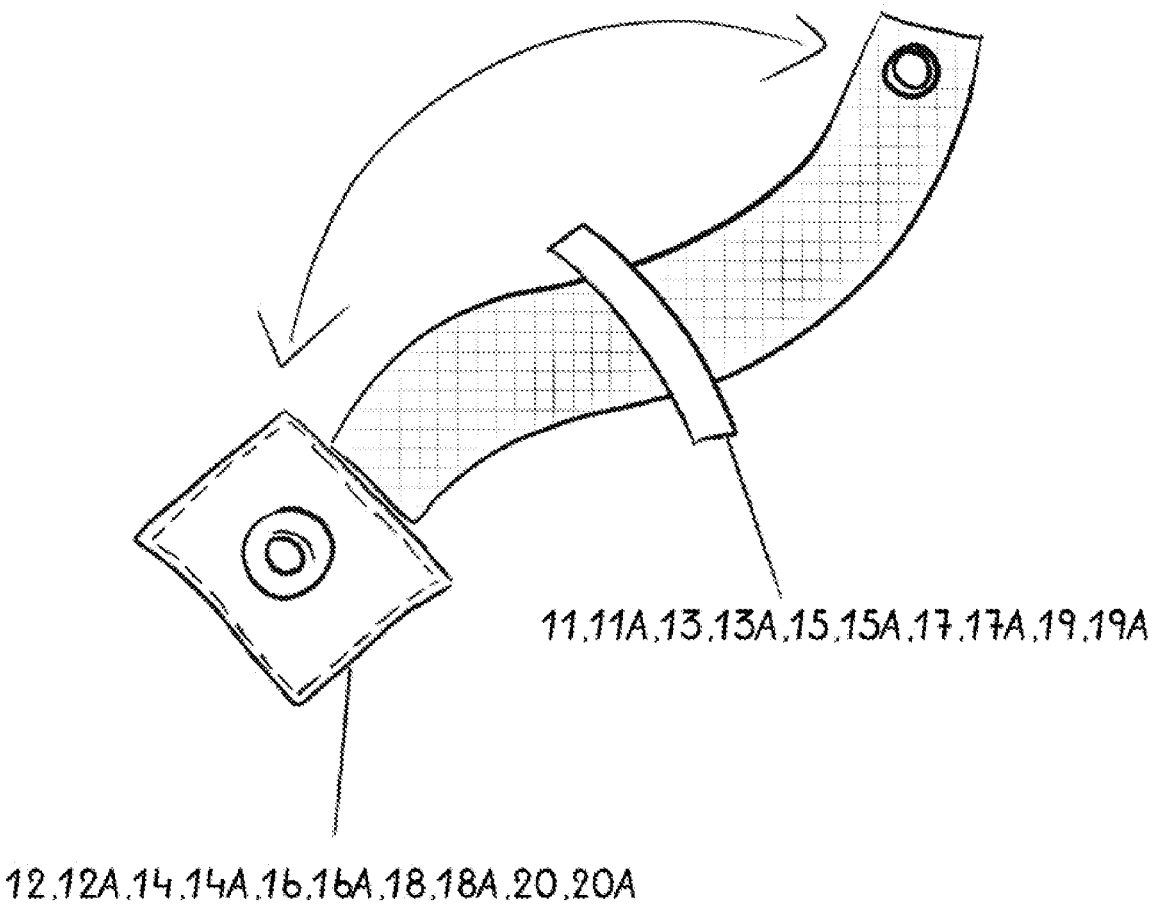
FIG. 2-FIG. 2 illustrates an example of snapping fasteners used in the special fastening mechanism that connects the two parts of the present invention, composing a protective jacket for motorcyclists with a detachable blazer as one example according to various embodiments described herein.

The outer and inner part composing the innovation, are connected together with special fastening mechanisms as perhaps best shown in FIG. 1-6. Preferably, the fastening mechanism is consisted of snapping fasteners and a zipper surrounding the interior of the blazer and the exterior of the protective jacket. The snapping fasteners, as perhaps best shown in FIG. 2, are consisted of snap straps 12,12A,14, 14A,16,16A,18,18A,20 and 20A that are positioned on the protective jacket and loops 11,11A,13,13A,15,15A,17,17A, 19,19A that are positioned on the blazer. A snapping fastener is considered to be in a locked position, when a snap strap goes through the loop and over, and then the button is snapped together forming a link between the snap strap and the loop. In preferred embodiments, the motorcycle jacket has two snap straps at the end of each sleeve, two snap straps under each armpit, and two snap straps at the bottom of the back on the inside of the jacket, while the blazer has two loops at the end of each sleeve, two loops under each armpit and two loops at the bottom of the back on the inside of the blazer accordingly. To connect the blazer and the protective jacket, the jacket must be first placed on the inside of the blazer and each snapping fastener must be locked in the following manner: the right sleeve top snap strap 14 with the right sleeve top loop 13, the right sleeve bottom snap strap 16 with the right sleeve bottom loop 15, the left sleeve top snap strap 14A with the left sleeve top loop 13A, the left sleeve bottom snap strap 16A with the left sleeve bottom loop 15A, the right armpit top snap strap 18 with the right armpit top loop 17, the right armpit bottom snap strap 20 with the right armpit bottom loop 19, the left armpit top snap strap 18A with the left armpit top loop 17A, the left armpit bottom snap strap 20A with the left armpit bottom loop 19A, the right back snap strap 12 with the right back loop 11 and the left back snap strap 12A with the left back loop 11A. Once all the snapping fasteners are in a locked position, the main connecting zipper 10 should be zippered, as perhaps best shown in FIG. 5-6, to fully connect the two main parts of the garment forming this invention. In certain embodiments, this fastening mechanism can be implemented with other forms of closing elements (hook-and-loop fasteners, straps, buttons, etc.) and the presented combination in the disclosure is to be considered as an exemplification.

Referring now to FIG. 1,4,7,8,9, on the shoulder, elbow and back areas of the protective jacket pockets for impact protectors are sewed as part of the lining. Preferably, this includes the right shoulder impact protector pocket 1, left shoulder impact protector pocket 1A, left elbow impact protector pocket 5, right elbow impact protector pocket 5A, and a back protector pocket 22. Within these pockets, right shoulder impact protector 2, left shoulder impact protector 2A, left elbow impact protector 6, right elbow impact protector 6A, and a back impact protector 23 are incorporated accordingly. The impact protectors represent additional protection to the disclosure since they provide the required impact protection to the rider in order to prevent injuries and bone fractures in case of an accident.

Figure 9:
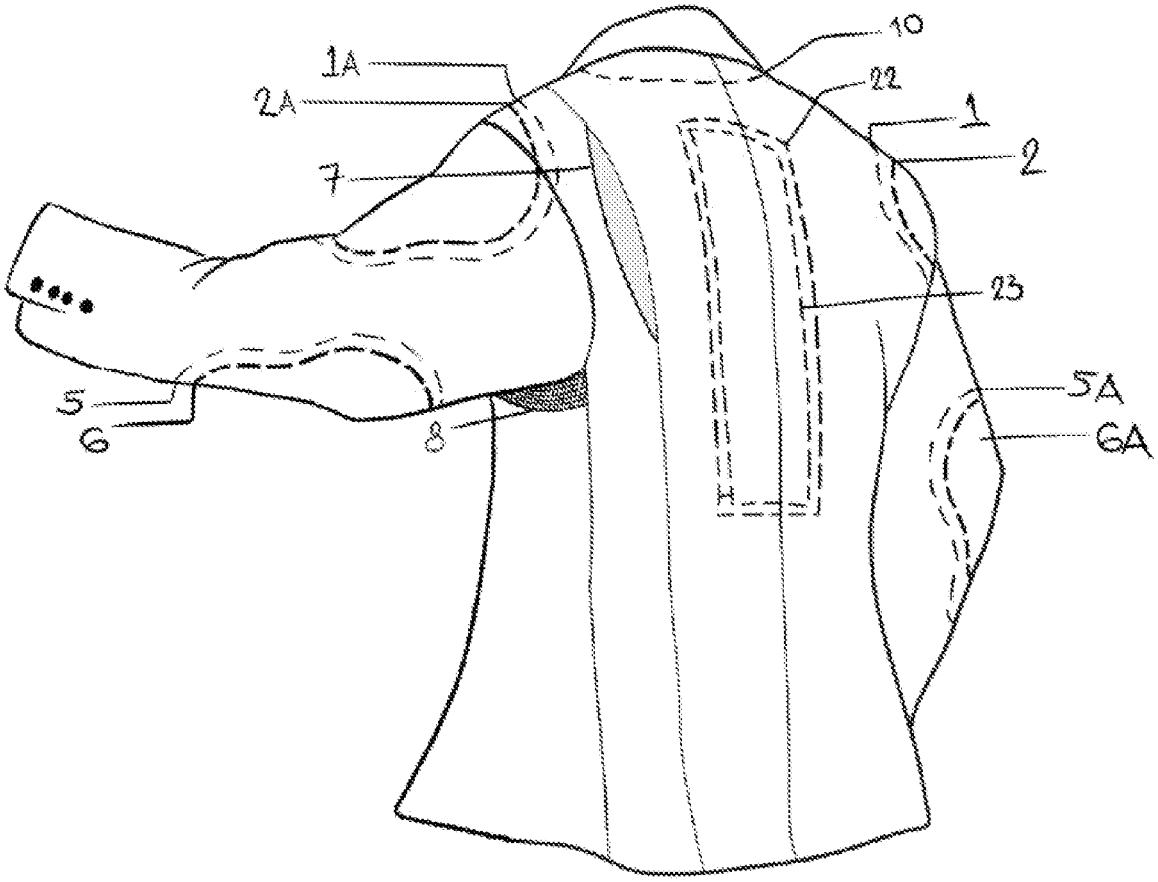
FIG. 9-FIG. 9 depicts an example of a side view of the protective jacket for motorcyclists with a detachable blazer in a riding position, with the arm raised and gusset expanded according to various embodiments described herein.

The invention is designed to enable great ergonomics and comfort while riding. Since motorcycles come in many different forms, the riding position of the body differs from upright to fully leaned forward. This challenges the classic blazer design as it limits certain body movements. That is why, in preferred embodiments the blazer part of the disclosure has special shoulder gussets incorporated on the back, left shoulder gusset 7, and right shoulder gusset 7A. FIG. 9 illustrates how the gussets expand as the rider leans and stretches the arms forward. This enables free movement of the arms and stretching of the rider's back to provide comfort in every riding position.

Figure 3:
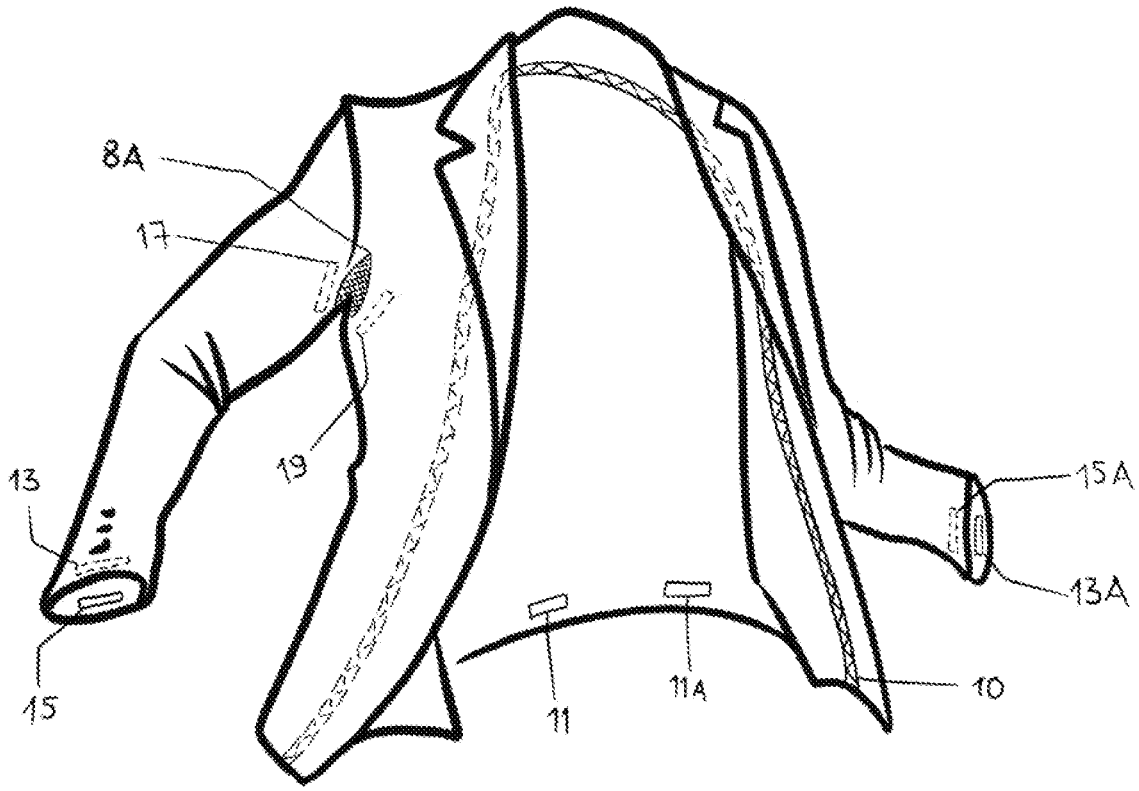
FIG. 3-FIG. 3 shows a perspective view of the blazer part of the present invention in an open/unbuttoned state as one example according to various embodiments described herein.
Figure 4:
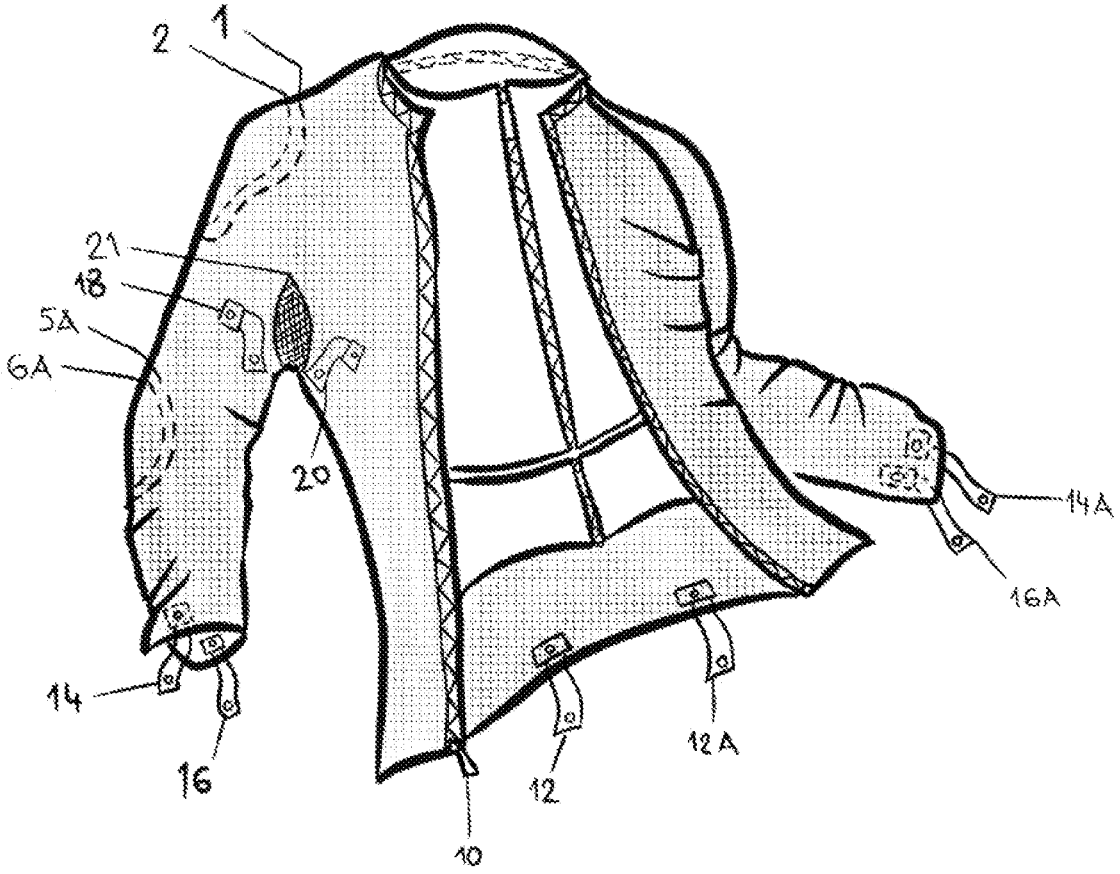
FIG. 4-FIG. 4 shows a perspective view of the protective jacket for motorcyclists as part of the present invention as one example according to various embodiments described herein.
Figure 5:
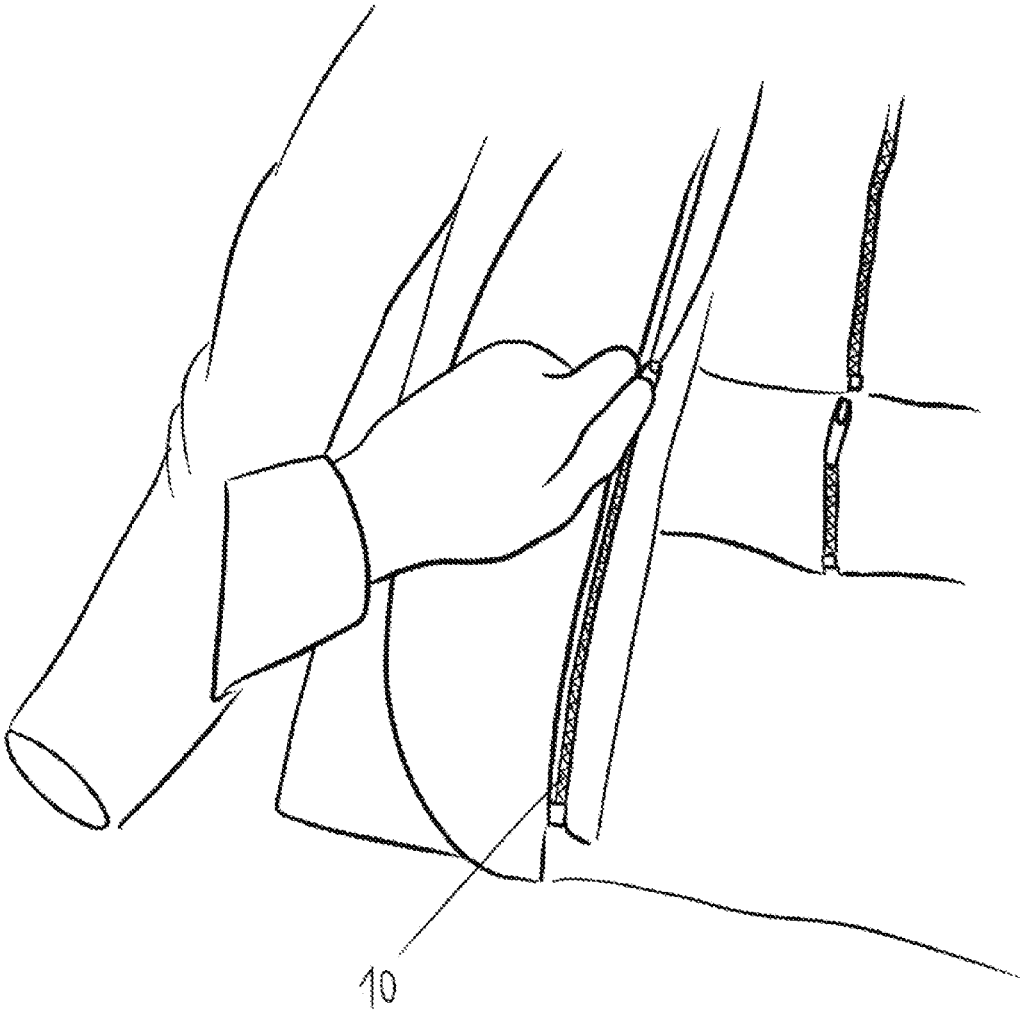
FIG. 5-FIG. 5 illustrates an example of the main connecting zipper used in the special fastening mechanism that connects the two parts of the present invention, composing a protective jacket for motorcyclists with a detachable blazer as one example according to various embodiments described herein.

As perhaps best shown in FIGS. 1,3 and 4, preferably a ventilation system is incorporated under the armpits of the rider. It consists of mesh panels located on the armpits of both the blazer as well as the protective jacket for motorcyclists composing the disclosure-left armpit ventilation mesh 8 and right armpit ventilation mesh 8A incorporated on the blazer as well as left armpit ventilation mesh 21A and right armpit ventilation mesh 21 incorporated on the protective jacket. These mesh panels cut through all fabric layers of each part of the invention to enable air circulation within the garment, making the ride more pleasant even on warmer days.

Figure 6:
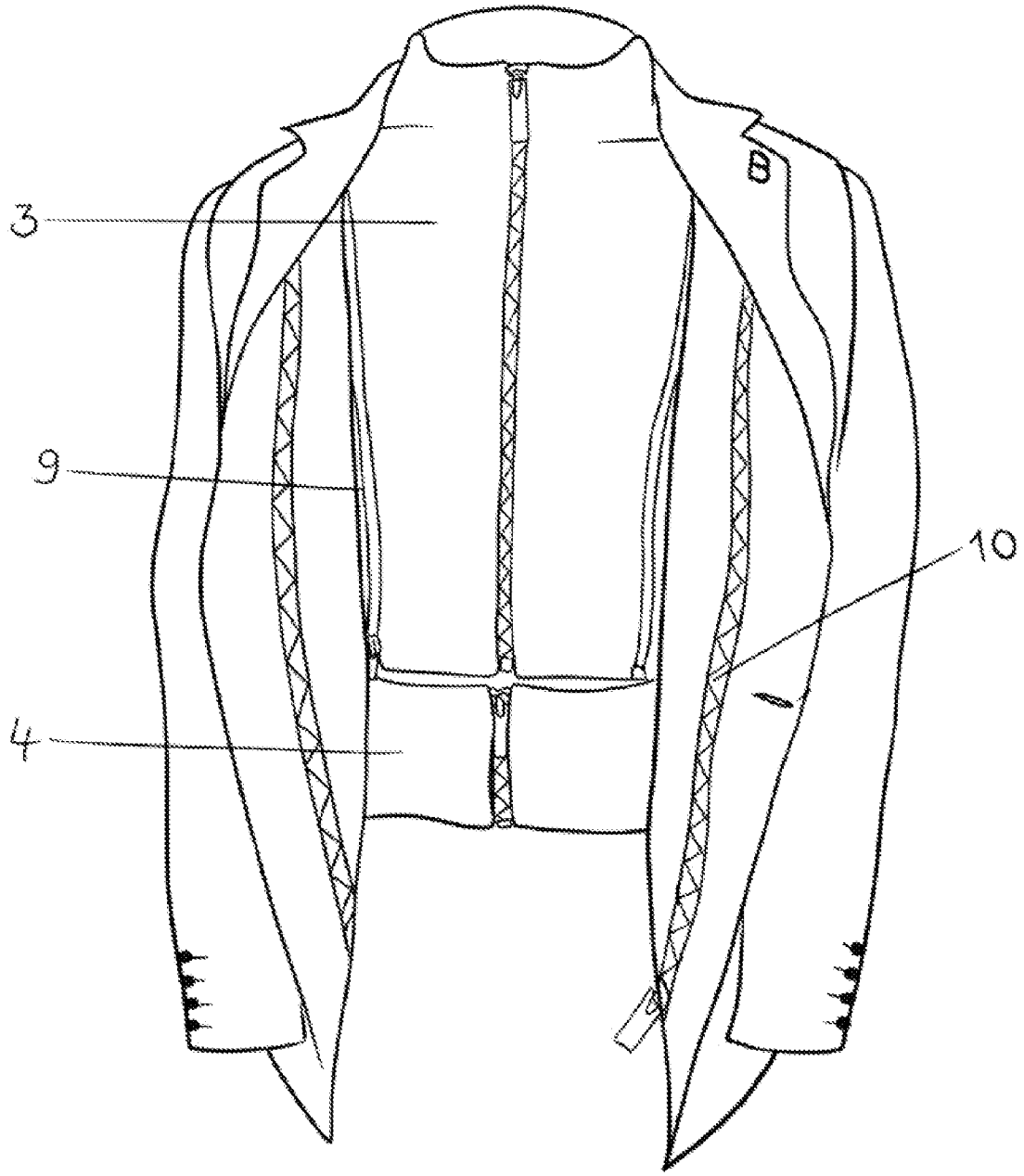
FIG. 6-FIG. 6 illustrates an example of a front view of the protective jacket for motorcyclists with a detachable blazer in a connected state, unbuttoned, showing the removable gilet, the novel fastening mechanism and the main zipper part of the special fastening mechanism.
Figure 7:
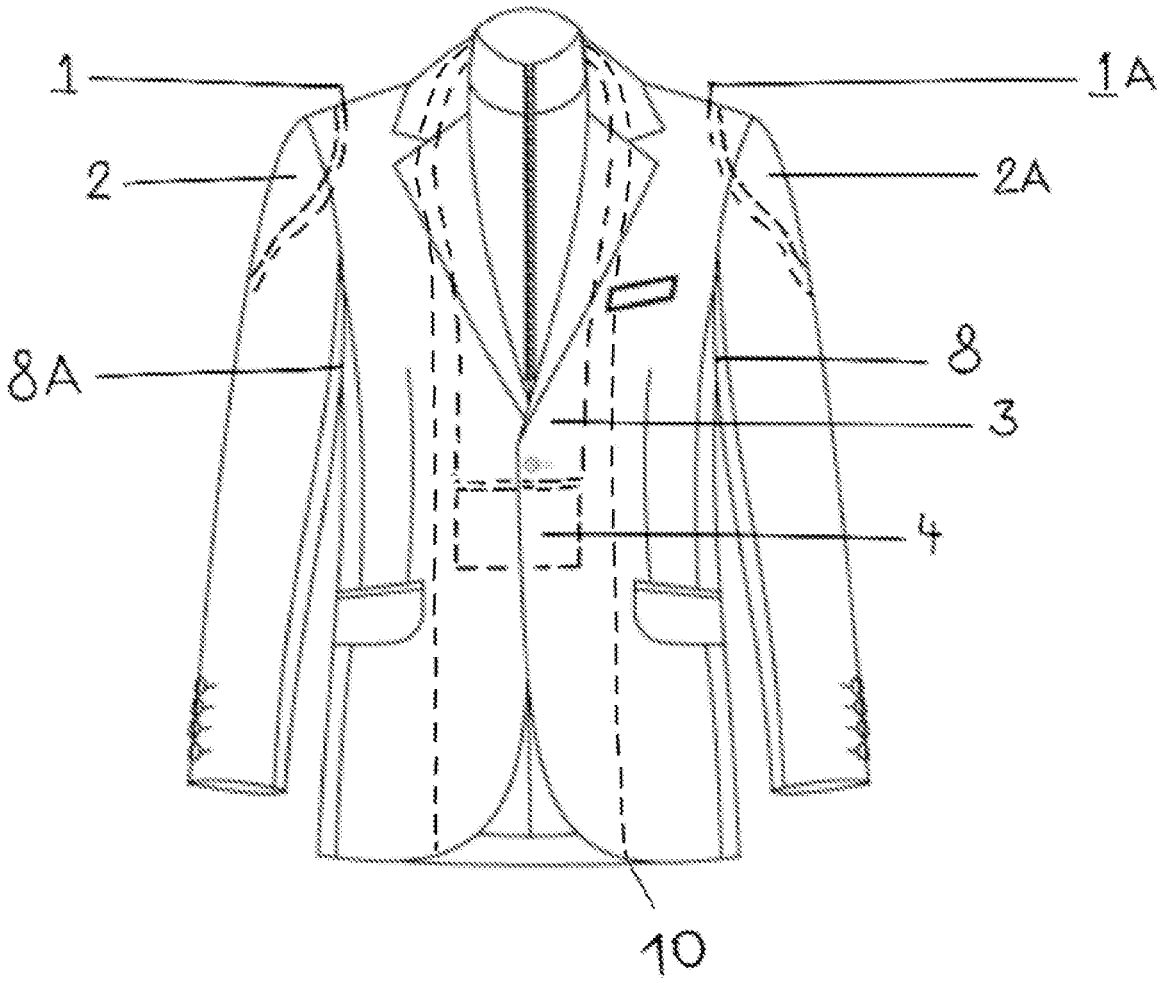
FIG. 7-FIG. 7 illustrates a front view of one example of the protective jacket for motorcyclists with a detachable blazer in a connected state according to various embodiments of the present invention.
Figure 8:
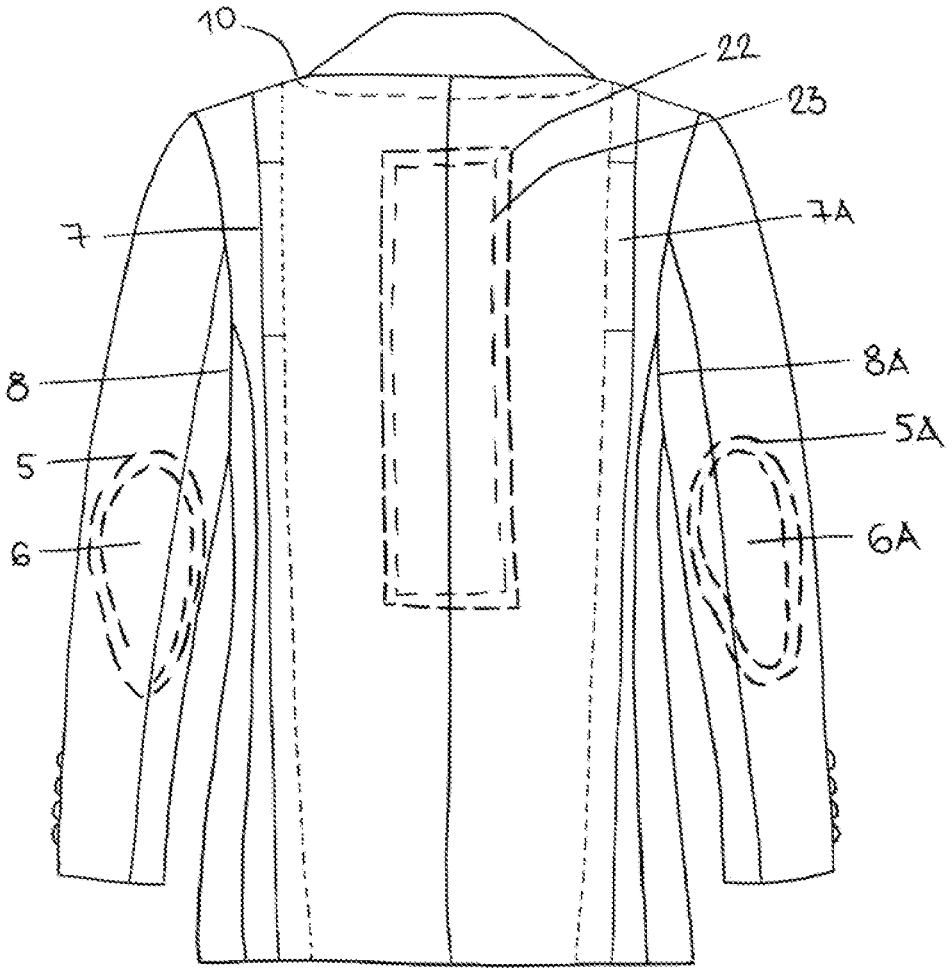
FIG. 8-FIG. 8 depicts a back view of one example of the protective jacket for motorcyclists with a detachable blazer in a connected state according to various embodiments described herein.

Referring now to FIG. 6, in preferred embodiments a novel fastening mechanism 4 is incorporated on the protective jacket for motorcyclists to prevent loss of the garment from the rider's body during a slide. This fastening mechanism is directly connected to the abrasion resistant fabric of the protective jacket to provide structural strength and to ensure that the garment stays on to protect the body of the motorcyclist in case of an accident.

In preferred embodiments, the innovation incorporates a removable windproof gilet 3 as a part of the protective jacket for motorcyclists, that covers the usually open chest and neck area. While riding, the upper body of the motorcyclist is constantly exposed to a colder wind, which in lower temperatures can lead to loss of concentration, slowed reaction, and even hypothermia. To prevent this from happening, the windproof gilet 3 provides the required wind protection so that even on colder days the rider can stay warm and focused on the road ahead. As perhaps best shown in FIG. 6, the windproof gilet 3 is connected to the protective jacket with a detachable zipper 9, allowing the rider to easily remove the gilet based on the occasion. Additionally, in certain embodiments this windproof gilet is reinforced with the same protective fabric used in the motorcycle jacket, providing additional protection to this area of the disclosure.

While preferred layers and materials have been described, the protective jacket for motorcyclists with a detachable blazer is not limited by these parts and materials.

The invention has been described herein in terms of preferred embodiments and methodologies considered by the inventors to represent the best mode of carrying out the invention. It will be understood by a skilled person in the field of motorcycle protective gear that a wide range of additions, deletions, and modifications, both subtle and gross, may be made to the illustrated and exemplary embodiments without departing from the spirit and scope of the invention. These and other revisions might be made by those with skill in the field of motorcycle protective gear without departing from the spirit and scope of the invention.

What is claimed is:

1. A protective motorcycle jacket with a detachable blazer for protecting a motorcyclist, comprising:

an outer part comprising the detachable blazer, the detachable blazer defining the appearance of the protective motorcycle jacket;

an inner part comprising abrasion resistant material, the inner part providing a frame for the detachable blazer and located underneath the outer part, the inner part configured to protect a wearer in a slide event or abrasion event during an accident;

the inner part securing to and covering the outer part with the abrasion resistant material to reinforce the outer part and protect the skin and torso of the wearer in a slide event or abrasion event during an accident; and a plurality of snapping fasteners positioned on the inner part adjacent to the wearer, each of the plurality of snapping fasteners includes a snap strap, the snap strap being configured to include a strap and a button, where the outer part comprises a plurality of loops, wherein the strap is configured to be received into a corresponding loop of the plurality of loops of the outer part, and the button is configured to secure the loop of the outer part to the inner part; and at least one pocket sewn on and formed along a part of the inner layer adjacent to the wearer, the at least one pocket configured to include an impact protector.

2. The protective motorcycle jacket of claim 1, wherein the at least one pocket comprises a first pair of pockets and a second pair of pockets, the first pair of pockets and the second pair of pockets sewn on and formed along a part of a lining of the interior of the inner part adjacent to the wearer, each pocket of the first pair of pockets being located in respective left and right shoulder areas of the protective motorcycle jacket and integrated with a shoulder impact protector, and each pocket of the second pair of pockets being located in respective left and right elbow areas of the protective motorcycle jacket and integrated with an elbow impact protector.

3. The protective motorcycle jacket of claim 1, further comprising a pair of mesh panels, each mesh panel of the pair of mesh panels located at or near an armpit region of the inner part for providing ventilation to the wearer, wherein the inner part extends across both armpit regions of the wearer, and the pair of mesh panels cut through the inner part.

4. The protective motorcycle jacket of claim 1, further comprising a pair of gussets disposed between a pair of shoulder panels on an exterior surface of the outer part, each gusset of the pair of gussets comprising textile fabric folded on top of itself for enabling freedom of movement for arms of the wearer and configured to extend along a back of the outer part.

5. The protective motorcycle jacket of claim 1, further comprising a fastening mechanism comprising abrasion resistant material, the fastening mechanism being integrally attached to the inner part and extending from the front left side of the inner part and from the front right side of the inner part, wherein the fastening mechanism integrally attaches to a lower torso of the frame of the inner part, and the fastening mechanism is configured to separate a left lower torso side of a front of the inner part from a right lower torso side of the front of the inner part when unfastened.

6. The protective motorcycle jacket of claim 1, further comprising a detachable gilet component attached to a front left breast panel and a front right breast panel of the inner part, the detachable gilet component covering an exposed chest and neck region of both the inner and outer part and providing wind protection to the wearer.

7. The protective motorcycle jacket of claim 1, wherein the outer part comprises an exposed chest region, a pair of lapels, a front left breast panel, a front right breast panel, and one or more buttons configured for securing the front left breast panel and the front right breast panel to each other.

8. The protective motorcycle jacket of claim 7, wherein the outer part further comprises one or more of: a breast pocket, a sleeve vent, a pocket flap, a front dart, a collar, and a roll line.

9. The protective motorcycle jacket of claim 7, wherein the exposed chest region is positioned between the pair of lapels.

10. The protective motorcycle jacket of claim 1, wherein the abrasion resistant material comprises at least one of an aramid or a para-aramid material.

11. The protective motorcycle jacket of claim 1, wherein the at least one pocket comprises a back pocket, the back pocket positioned on an interior surface of the inner part, the back pocket centrally located in a back panel of the inner part and integrated with a back protector.

12. A protective motorcycle jacket with a detachable blazer, comprising:

an outer blazer component made of fabric and forms the detachable blazer, the outer blazer component including:

a left breast panel and a right breast panel, and a first fastening mechanism configured for securing the left breast panel and the right breast panel together across a torso of a wearer of the protective motorcycle jacket;

an inner abrasion resistant component made from abrasion resistant material and forms the frame of the protective motorcycle jacket, the inner abrasion resistant component secures to the outer blazer component and reinforces the outer blazer component with abrasion resistant material to protect the skin and torso of the wearer in a slide event or abrasion event during an accident, the inner abrasion resistant component being located underneath the outer blazer component and providing a frame for the detachable blazer;

a second fastening mechanism comprising abrasion resistant material, the second fastening mechanism being positioned beneath the first fastening mechanism, the second fastening mechanism integrally attaches to a lower torso of the inner abrasion resistant component, and the second fastening mechanism is configured to separate a left lower torso side of a front of the inner abrasion resistant component from a right lower torso side of the front of the inner abrasion resistant component when unfastened;

a plurality of snapping fasteners positioned on the inner part adjacent to the wearer, each of the plurality of snapping fasteners includes a snap strap, the snap strap being configured to include a strap and a button, where the outer part comprises a plurality of loops, wherein the strap is configured to be received into a corresponding loop of the plurality of loops of the outer part, and the button is configured to secure the loop of the outer part to the inner part; and at least one pocket sewn on and formed along a part of the inner layer adjacent to the wearer, the at least one pocket configured to include an impact protector;

wherein the outer blazer component is configured to be detachable from the inner abrasion resistant component.

13. The protective motorcycle jacket of claim 12, wherein the at least one pocket comprises a first pair of pockets and a second pair of pockets, each pocket of the first pair of pockets being located in respective left and right shoulder areas of the protective motorcycle jacket, wherein an impact protector is positioned within each pocket of the first pair of pockets, and each pocket of the second pair of pockets being located in respective left and right elbow areas of the protective motorcycle jacket, wherein an impact protector is positioned within each pocket of the second pair of pockets.

14. The protective motorcycle jacket of claim 12, further comprising a pair of mesh panels, each mesh panel of the pair of mesh panels located at or near an armpit region of the inner abrasion resistant component for providing ventilation to the wearer, wherein the inner abrasion resistant component extends across both armpit regions of the wearer, and the pair of mesh panels cut through the inner abrasion resistant component.

15. The protective motorcycle jacket of claim 12, further comprising a pair of gussets disposed between a back panel and a pair of shoulder panels of the outer blazer component, each gusset of the pair of gussets comprising textile fabric folded on top of itself for enabling freedom of movement for arms of the wearer and configured to extend along a back of the outer blazer component.

16. The protective motorcycle jacket of claim 12, further comprising a detachable gilet component attached to the left breast panel and the right breast panel of the inner abrasion resistant component, the detachable gilet component covering an exposed chest and neck region of both the inner abrasion resistant component and the outer blazer component and providing wind protection to the wearer.

17. The protective motorcycle jacket of claim 16, wherein the detachable gilet component is configured to secure to the inner abrasion resistant component by one or more zippers.

18. The protective motorcycle jacket of claim 16, the inner abrasion resistant component is configured to include one or more zippers for securing the detachable gilet component to the frame of the inner abrasion resistant component.

19. The protective motorcycle jacket of claim 12, further comprising a back protector pocket, the back protector pocket positioned on an interior surface of the inner abrasion resistant component, the back protector pocket being integrated centrally into a back panel of the inner abrasion resistant component, the back protector pocket being integrated with a back protector.

20. The protective motorcycle jacket of claim 12, wherein an exposed chest region is positioned between a pair of lapels.

21. The protective motorcycle jacket of claim 12, wherein the inner abrasion resistant component further comprises a zipper surrounding the exterior border of the inner abrasion resistant component, the zipper configured to secure the detachable garment to the inner abrasion resistant component.

* * * * *